United States Patent [19]

Smith

[11] Patent Number: 4,685,250

[45] **Date of Patent: * Aug. 11, 1987**

[54] SHARPENER FOR INDUSTRIAL KNIFE BLADES

[76] Inventor: Leward N. Smith, Rte. 4, Box 160, Deckle Rd., Lake City, Fla. 32055

[ * ] Notice: The portion of the term of this patent subsequent to Feb. 2, 1999 has been disclaimed.

[21] Appl. No.: 598,708

[22] Filed: Apr. 10, 1984

Related U.S. Application Data

[63] Continuation of Ser. No. 79,353, Sep. 27, 1979, Pat. No. 4,313,283, and a continuation of Ser. No. 297,930, Aug. 31, 1981, Pat. No. 4,442,635.

[51] Int. Cl.[4] ..... B24B 3/55; B24B 7/02

[52] U.S. Cl. ..... 51/56 R

[58] Field of Search ..... 51/166 MH, 166 TS, 166 R, 51/34 R, 34 C, 56 R, 36, 98 BS, 109 BS, 217 R, 125, 218 R, 33 HK, 228, 247, 236, 249, 31, 54, 166 FB

[56] References Cited

U.S. PATENT DOCUMENTS

| | | | |
|---|---|---|---|
| 1,034,422 | 8/1912 | Christiansen . | |
| 2,069,097 | 1/1937 | Root | 51/56 |
| 2,717,477 | 9/1955 | Moulton | 51/36 |
| 2,807,123 | 9/1957 | Palmer | 51/34 R |
| 2,865,140 | 12/1958 | Shumway | 51/34 R |
| 3,099,111 | 7/1963 | Allison . | |
| 3,380,199 | 4/1968 | Bradstreet | 51/56 |
| 3,418,757 | 12/1968 | McEwan | 51/34 R |
| 3,590,536 | 7/1971 | Fisher | 51/236 |
| 3,726,047 | 4/1973 | Long | 51/241 S |
| 3,733,753 | 5/1973 | Miller | 51/34 E |
| 3,741,674 | 6/1973 | Witzig | 308/3 A |
| 4,313,283 | 2/1982 | Smith | 51/56 R |

OTHER PUBLICATIONS

"Hanchett Models MG/LG Traveling Table Knife Grinders" Hanchett Manufacturing Co.
"Reform Grinding Machines/Type 6S".
"Gachel—Machine Construction".

*Primary Examiner*—Roscoe V. Parker

[57] ABSTRACT

A sharpener for industrial knife blades comprises a frame for retaining the blades therein, and an elongate beam having an inelastically deformable way surface. A grinder is slideably mounted on the beam by rollers which abuttingly engage the way surface. The rollers and the way surface are urged together, whereby repeated translation of the grinder along the beam causes the rollers to impress a hollow or concave track in the way surface, wherein the rollers are retained and guided for accurate grinding of the knife blades.

10 Claims, 11 Drawing Figures

SHARPENER FOR INDUSTRIAL KNIFE BLADES

This is a continuation of: application Ser. No. 79,353, filed Sept. 27, 1979 on SHARPENER FOR INDUSTRIAL KNIFE BLADES, now U.S. Pat. No. 4,313,283; and Ser. No. 297,930, filed Aug. 31, 1981, now U.S. Pat. No. 4,442,635.

BACKGROUND OF THE INVENTION

The present invention relates to knife sharpeners, and in particular to a sharpener for knife blades used in industrial machinery and the like.

Knife blades are used in a wide variety of different types of industrial equipment, such as agricultural harvesters, tobacco choppers, vegetable and fruit peelers, wood chippers, and the like. Such devices are designed to cut a particular type of material, and typically include a releasable blade locking arrangement to remove the blades from the apparatus so that they can be periodically cleaned and sharpened.

A great many of these machinery blades are quite large, such that special techniques must be employed to properly sharpen the same. For example, the blades of a wood chipping device used in milling lumber are in the nature of 24 inches long, five inches wide, one-half inch thick, and weigh approximately 25 pounds. These blades are constructed of a high carbon steel to retain a sharp edge. However, due to the harsh treatment which they receive during use, the blades must be removed from the chipper and sharpened after every few hours of operation. Further, a great number of such cutting machines employ a plurality of blade sets, each having a different cutting angle, to adapt the machine to efficiently cut the wood or other product when the physical characteristics thereof, such as moisture content, seasoning, and the like, vary. Hence, sharpeners for such cutting blades preferably include means which enable the same to quickly alter the sharpening angle so as to facilitate the sharpening of the different blade sets.

Tool grinders are available for sharpening industrial knife blades. However, the same are quite massive and very expensive devices, which have a degree of precision which is not required to properly sharpen the above described type of industrial machinery blades. Heretofore, such sharpeners were in the nature of very precise machine tool grinders, with extremely accurate meonite, hand scraped ways in which the translating portions of the grinder are mounted. The grinder head of such devices are typically stationary, and include a traveling bed or table on which the blades are mounted. The ways have force fed lubrication, so that the edge of the knife blades can be very exactly ground to a close tolerance in the nature of a few thousandths of an inch, such as is required for paper cutters and veneer knives. Such precision tool grinders are not only expensive, but are also incapable of being set up quickly and/or easily adapted to accommodate different sharpening angles. Also, the precision grinders are designed for operation in a relatively clean tool room environment, as opposed to the processing areas in which the wood chipping machines are used, such as a wood mill.

SUMMARY OF THE INVENTION

The principal objects of the present invention are: to provide a structurally uncomplicated and inexpensive sharpener for industrial machinery knife blades; to provide such a sharpener in which dull blades are quickly and easily connected to the device for sharpening; to provide a sharpener which is easily adjustable to sharpen different cutting blade angles; to provide a sharpener with accuracy sufficient for sharpening a great variety of industrial knife blades; to provide a sharpener which is adapted to operate efficiently in unclean environments without detrimental effects; and to provide a sharpener which is economical to manufacture, efficient in use, capable of a long operating life, and particularly well adapted for the proposed use.

These and many other important features, advantages, and objects of the invention will be further understood and appreciated by those skilled in the art by reference to the following written specification, claims and appended drawings.

DETAILED DESCRIPTION OF THE PREFERRED EMBODIMENTS

Figure 1:
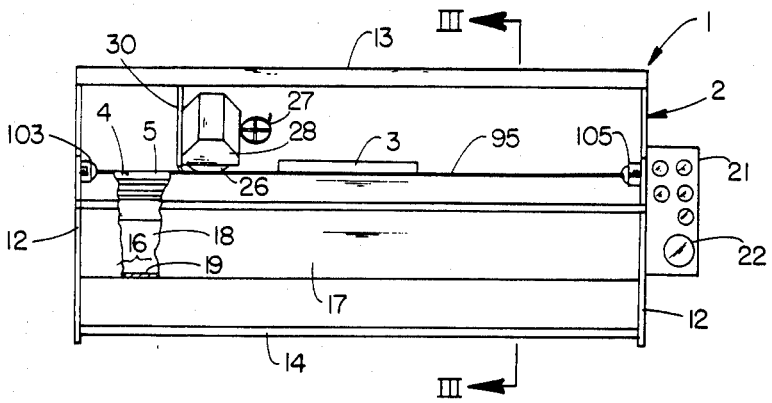
FIG. 1 is a front elevational view of a sharpener embodying the present invention, with portions thereof broken away to reveal internal construction.

For purposes of description herein, the terms "upper", "lower", "right", "left", "rear", "front", "vertical", "horizontal", and derivatives thereof shall relate to the invention as oriented in FIG. 1. However, it is to be understood that the invention may assume various alternative orientations, except where expressly specified to the contrary.

Figure 2:
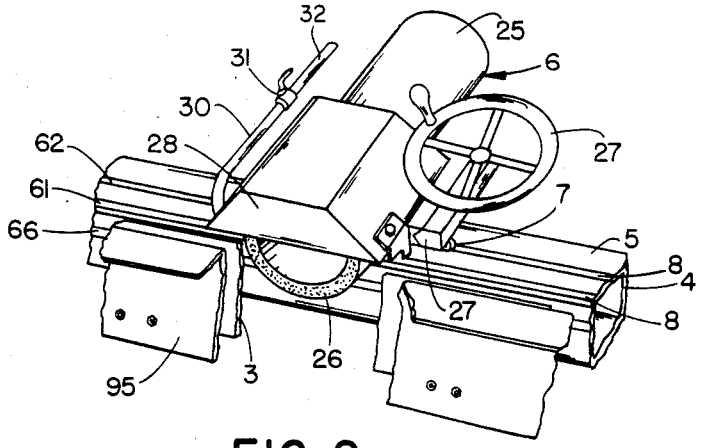
FIG. 2 is an enlarged fragmentary perspective view of a grinder portion of the sharpener, with portions thereof broken away.

The reference numeral 1 generally designates a sharpener embodying the present invention, comprising a main frame 2 (FIG. 1) having means for releasably retaining a knife blade 3 in a fixed relationship therewith, and an elongate beam 4 having a way surface 5. As best shown in FIG. 2, the way surface 5 is substantially planar and inelastically deformable. A grinder assembly 6 is provided for sharpening a cutting edge of the knife blade 3, and includes rollers 7 which are abuttingly supported on the way surface 5 and slideably mount the grinder 6 on beam 4 for translation thereon along a plane which is substantially parallel with the knife blade cutting edge. Means urges the rollers 7 and beam 4 together, whereby repeated translation of the grinder 6 along the beam 4 causes the rollers 7 to impress or roll form at least one concave track 8 in the way surface 5, wherein the rollers are retained and guided for accurate grinding of the knife blades. As used herein, the term "concave" is intended to mean hollowed or depressed, and is not limited to any particular shape.

Figure 3:
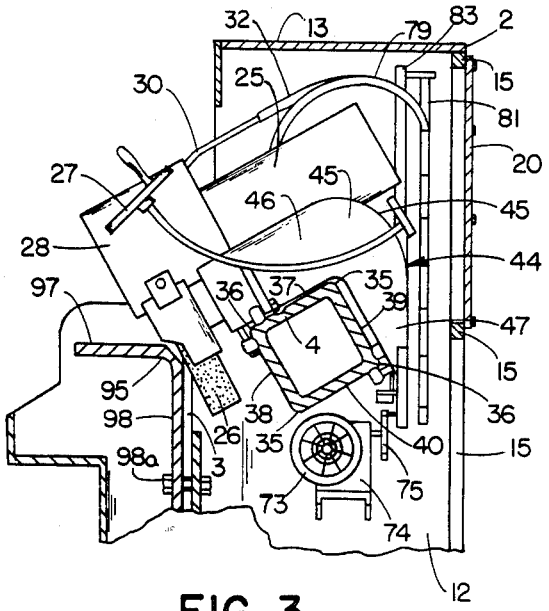
FIG. 3 is a vertical cross-sectional view of the sharpener taken along the section line III—III, FIG. 1.

As best illustrated in FIGS. 1 and 3, the main frame 2 comprises a pair of spaced apart end walls 12 connected with opposing ends of the beam 4, a top panel 13, a bottom brace 14, and rear braces 15 which are securely interconnected to form a rigid frame structure. The main frame 2 includes a trough or reservior 16 (FIG. 1) which is shaped to retain a grinding coolant fluid such as water therein. The reservoir 16 is disposed below the beam 4 and is formed by front, rear, and bottom panels 17, 18 and 19 respectively, and extends between the end walls 12 along the longitudinal axis of the frame. A cover plate 20 (FIG. 3) is attached to the exterior surface of the rear braces 15, and forms a closure for the upper portion of the sharpener. A control panel 21 (FIG. 1) is provided to encase and protect the electrical control components of the sharpener, and is attached to the main frame end wall 12 at a position which is convenient to manipulate the various switches and observe the various indicators 22.

The grinder 6 illustrated in FIGS. 2 and 3 includes a drive motor 25 which rotates an abrasive element 26, such as a grinding stone or wheel. The motor 25 and grinding wheel 26 are mounted on V-shaped guide rails 27 disposed on opposing sides of the grinder, and include a conventional screw drive mechanism (not shown) and control wheel 29 to translate the grinder longitudinally on the rails 27 (i.e., toward and away knife blade) to control depth of the grinding operation by adjusting the position of the grinding wheel 26 with respect to the knife blade 3. A cover or guard 28 encases the upper portion of the grinding wheel 26 and is connected in a fixed relation with the grinding wheel and motor 25, and translates therewith longitudinally along the rail 27, and transversely along the beam 4. A coolant supply line 30 with a control valve 31 is positioned adjacent to the grinding wheel 26 and is coupled to the reservoir 18 by pump means (not shown) to direct cooling fluid onto the knife blades 3 at an area adjacent to the grinding wheel 26. The rearward portion 32 of the coolant supply line is flexible, and the forward portion 30, like the guard 28, is preferably connected with the grinder 6 in a fixed relationship, and translates therewith for purposes to be described in detail hereinafter.

Beam 4 extends between the end walls 12 along a substantially horizontal plane, and has its ends rigidly connected therewith. The illustrated beam 4 (FIG. 4) is tubular, and has a substantially rectangular or square transverse cross-sectional shape with two pairs of diametrically opposed corner edges 35 and 36 (FIGS. 3 and 4), which are rounded slightly to eliminate sharp edges. The beam 4 is canted or angled forwardly, and defines two forward surfaces 37 and 38 on the upper and lower sides of the beam respectively, and upper and lower rearward surfaces 39 and 40 respectively. The beam is canted such that the upper surfaces 37 and 39 assume an inverted V-shaped configuration, and in the illustrated structure, is canted forwardly from the horizon at an angle in the nature of 30 degrees. The beam 4 is preferably constructed of a segment of standard structural steel tubing, such as SAE 1018–1020, with a face width in the nature of eight inches.

Figure 4:
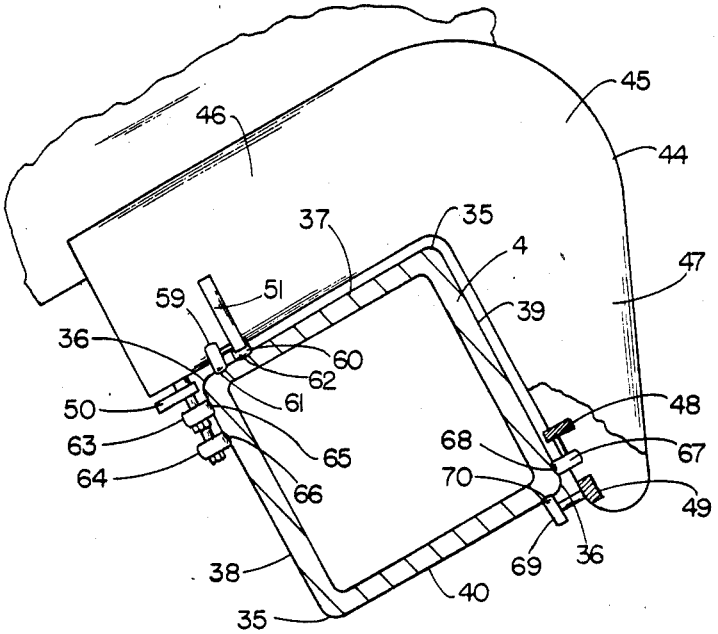
FIG. 4 is an enlarged fragmentary cross-sectional view of the sharpener, particularly showing a beam and carriage frame portion thereof.

In this example, the grinder 6 is slideably connected to the beam 4 by a carriage frame 44 (FIGS. 3 and 4). The carriage frame 44 includes two L-shaped supports 45 which are disposed on opposing sides of the grinder, and are fixedly attached to the guide rails 27, whereby the motor 25 and grinding wheel 26 translate with respect thereto. The L-shaped supports 45 straddle the beam 4, and include interconnecting upper and lower arm members 46 and 47 which are perpendicularly oriented and extend over the beam surfaces 37 and 39 respectively. Each of the arms 46 and 47 is preferably semi-rigid and resilient, in the nature of a leaf spring, such that the free ends of the arm members can be diverged slightly from their normal perpendicular position, so as to tense the arms and create an inwardly directed spring force therein for purposes to be described more fully hereinafter. Cross braces 48 and 49 (FIG. 4) extend transversely between the lower arms 47 of the L-shaped supports 45, and securely interconnect the same. A forward cross brace 50 extends between the upper support arms 46, and a pair of triangularly shaped brackets 51 and 52 extend from the exterior surface of the same, and are adapted to mount a roller 7 thereon.

Figure 8:
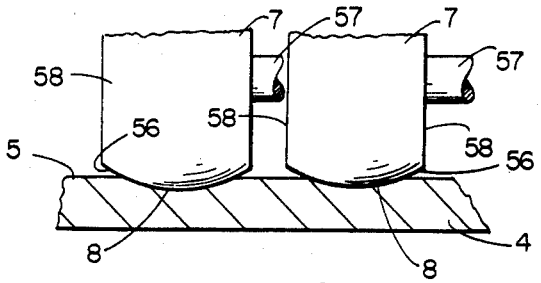
FIG. 8 is an enlarged cross-sectional view of the beam, particularly showing ways formed in the beam and rollers positioned therein.

As best illustrated in FIG. 8, the rollers 7 have a peripheral outer contacting surface 56, which preferably has a transverse cross-sectional shape which is non-linear. Because of the non-linear shape of the periphery of the rollers and mating tracks, such as with a U-shape, V-shape, ridge and channel arrangements, or the like, the rollers are self-aligning in the tracks and provide accurate tracking of the grinder 6 on beam 4. In the illustrated structure, the transverse cross-sectional shape of the rollers 7 is arcuate, such that the track 8 has a smooth, substantially uninterrupted arcuately concave surface. The rollers 7 impress the track 8 in the inelastically deformable way surface 5 to a self-seeking depth which provides sufficient surface area to non-deformably support the rollers 7 thereon. The width of the periphial surface 56 of the rollers is substantially greater than that required to non-deformably support the rollers on the way surface, such that the sides 58 of the rollers are always disposed above the way surface 5. In the illustrated structure, the tracks have a depth of approximately 0.050 inches and a width of about three-fourths of an inch, and the rollers have an outside diameter of three inches, a width of one inch, and the roller peripherial surface is rounded on four-inch radius. The peripherial surface 56 of the rollers is preferably quite hard relative to the hardness of the way surface 5, such that substantially all of the deformation which results from the rolling contact between the two surfaces occurs in the way surface thereby forming the tracks by cold working. In this example, the roller surface 56 has a hardness in the nature of Rockwell C 50–70. The illustrated rollers 7 are rotatably mounted on eccentric shafts 57, such that rotation of any one of the shafts translates the associated roller toward and away from the way surface 5.

Figure 5:
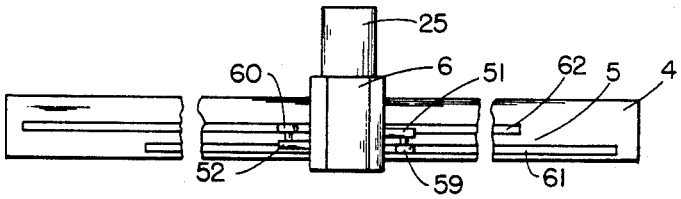
FIG. 5 is a partially schematic top plan view of the beam and grinder portions of the sharpener.
Figure 6:
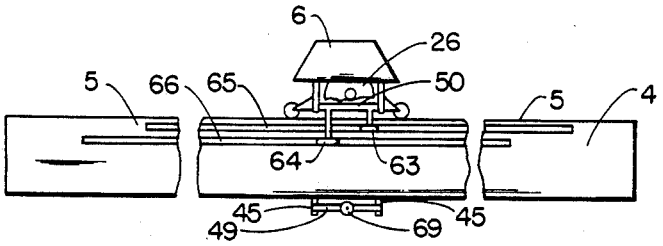
FIG. 6 is a partially schematic front elevational view of the beam and grinder portions of the sharpener.
Figure 7:
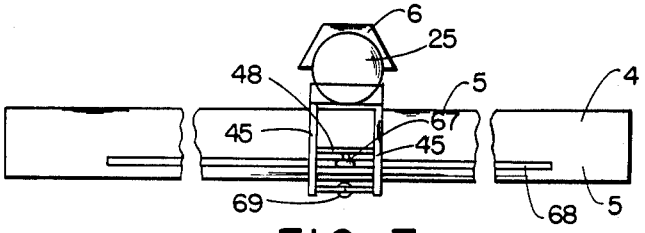
FIG. 7 is a partially schematic rear elevational view of the beam and grinder portions of the sharpener.

As best illustrated in FIG. 4, the rollers 7 are disposed on adjacent surfaces of the beam 4 at the forwardmost and rearwardmost corner edges 36. First and second rollers 59 and 60 are mounted on the triangular supports 51 and 52 at the forward upper portion of the device, and are guided in tracks 61 and 62 respectively. The rollers 59 and 60 extend in opposite directions from the associated bracket and are spaced apart whereby the rollers form completely separate tracks in which the rollers are individually retained for smooth translation of the grinder. If the two rollers were aligned, in the present sharpener arrangement, only a single track would be formed, and the track surface would not be evenly worn due to the overlapping translation pattern of the rollers as illustrated in FIGS. 4 and 5, thereby resulting in bumps or undulations in the way surface which would ruin the accuracy of the grinder. Third and fourth rollers 63 and 64 (FIGS. 4 and 6) are mounted on the forward support 50 in a spaced apart fashion, and extend downwardly thereof and engage the forward lower way surface 38. Rollers 63 and 64, like the above described rollers 61 and 62, are spaced apart on the way surface 38, so as to form two separate tracks 65 and 66 therein. A fifth roller 67 is mounted on the rear support 48 at a medial portion thereof, and engages the rearward upper way surface 39 and is guided in the concave mating track 68. A sixth roller 69 is connected at a medial portion of the support 49, and extends forwardly thereof the engage the rearward lower way surface 40, and the mating concave track 70.

Each of the rollers 7 is oriented in a manner such that the rolling plane of each of the rollers, as well as the tracks, are parallel with the central axis of the beam. The rollers 7 are mounted on the carriage frame 44 to engage each surface of the rectangular beam, and are arranged in two sets 59 and 60-69, and 63 and 64-67 located on the opposing pairs of beam surfaces 37-40 and 38-39 respectively. The carriage frame thereby captures the beam between the rollers, and adjustment of the roller position with respect to the way surface, by means such as the eccentric shafts 57, securely retains the carriage on the beam.

Figure 11:
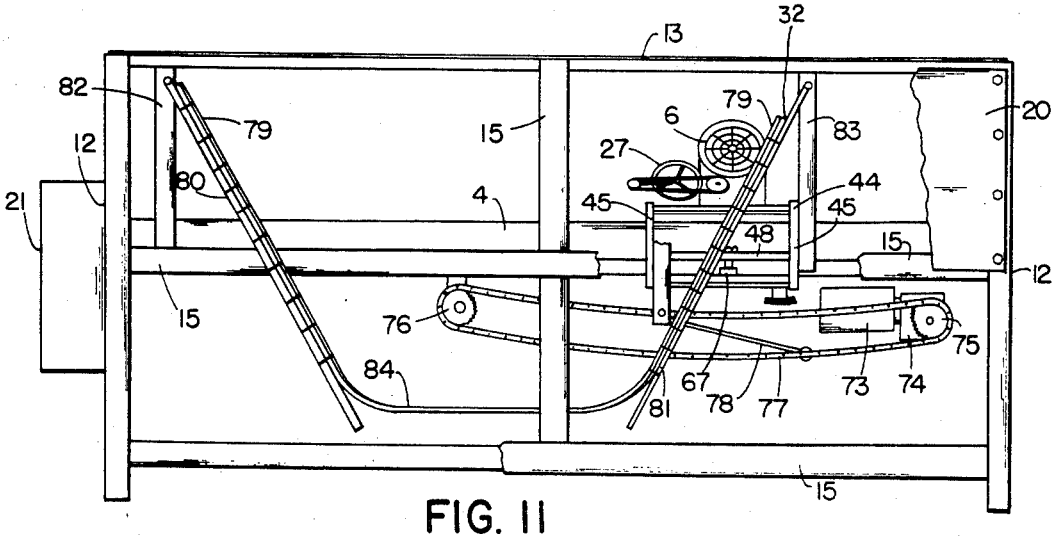
FIG. 11 is a rear elevational view of the sharpener partly broken away.

The carriage frame 44 may be translated along the beam by virtually any suitable mechanical means, including manual translation, and in the structure illustrated in FIG. 11, a power drive mechanism is provided. An electric motor 73 is attached to a medial frame member 15, and includes a speed reducer 74 having a sprocket 75 mounted on the output shaft thereof. A return sprocket 76 is also mounted on the frame member 15 at a spaced-apart distance from and in-line with the drive sprocket 75, and a roller chain 77 extends between the sprockets and is entrained therewith. A connecting rod 78 has the ends thereof pivotally connected with the drive chain 75 and the carriage frame 44, whereby rotation of the drive sprocket 76 selectively translates the grinder 6 back and forth along the beam 4 at a preselected speed and direction.

The drive mechanism is provided with a harness or anti-fouling device to insure that the electical power and control wires 79 (FIG. 11) to the motor 73, and the coolant supply line 30, do not become tangled when the grinder 6 is translated. A pair of arms 80 and 81 are pivotally mounted at the upper ends thereof to spaced apart, upstanding support members 82 and 83 respectively. One of the support members 82 is fixedly connected with the frame 2, and the other support member 83 is connected with the carriage frame 44 and moves therewith. The wires or cables 79 extend from the control panel 21 to the left arm 80 (as oriented in FIG. 11) and are connected along the length thereof by suitable fastening means, such as clamps, tape, or the like. The wire 79 then extends through a free or catenary medial portion 84 to the right hand arm 81, and is attached thereto, with the free end of the wire connected with the grinder motor 73. In like manner, the flexible coolant supply line 32, which extends between the reservoir 16 and the spout 30, is connected with the arms 80 and 81. Translation of the carriage frame 44 in a right hand direction tenses both the wire medial portion 84, and the coolant line center portion, and pivots the arms 80 and 81 inwardly to extend the wire and coolant hose. Movement of the carriage frame 44 in the opposite direction causes arms 80 and 81 to rotate under gravitational forces in an outwardly direction and slacken the wire 79 and coolant hose 32. Arms 80 and 81 and the attached wire and coolant hose segments pivot along a plane which is free from obstruction with the other portion of the sharpener, thereby preventing fouling of the wire and/or hose.

Figure 9:
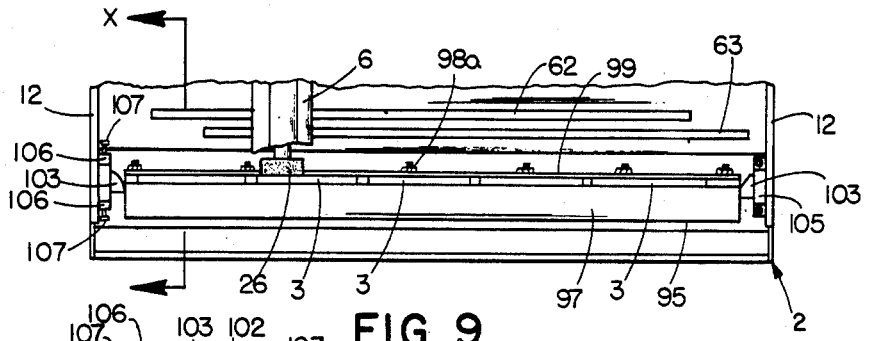
FIG. 9 is a partially schematic top plan view of the sharpener, particularly showing a knife retaining bracket portion thereof.
Figure 10:
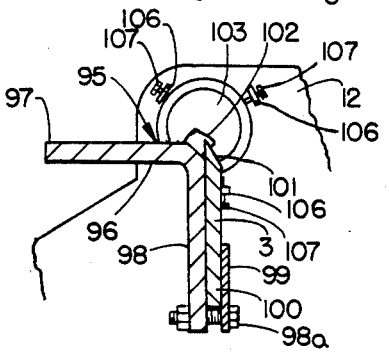
FIG. 10 is an enlarged cross-sectional view of the knife retaining bracket portion, taken along section line X—X, FIG. 9.

As best illustrated in FIGS. 9 and 10, the sharpener 1 includes a bracket 95 for releasably retaining a plurality of knife blades 3 in the main frame 2. The bracket 95 is rotatably mounted in the main frame 2 in a manner wherein the knife blades 3 are oriented substantially along the plane which intersects the axis of rotation of the bracket, whereby the blades are rotatably mounted in the frame to vary the blade cutting edge presented to the abrasive element or grinding wheel 26 without requiring substantially any repositioning of the entire grinder. The illustrated bracket 95 includes an elongate, inverted L-shaped angle member 96 with upper and lower legs 97 and 98 respectively, and a plate 99 detachably connected along the lower edge of the angle member lower leg 98 by fasteners **98*a* to receive and retain a lower edge 100 of the knife blade 3 therein. The angle member 96 and the plate 99 are elongated and extend between the end walls 12 of the main frame 2, and are adapted to retain a plurality of knife blades 3 therein in a side-by-side fashion, as illustrated in FIG. 9. With reference to FIG. 10, the lower leg 98 of the angle member 96 has a height which extends slightly below the uppermost portion of the blade cutting edge 101 so as to maintain contact therewith and conduct heat away from the blade during sharpening. The angle member 96 includes a bevel cut edge 102 at the intersection of the legs 97 and 98 to provide a small reservoir of coolant for cooling the blade members 3. A trunnion or journal 103 is attached to each end of the angle member 96 at a point adjacent to the flat edge 102, in a manner such that when the bracket leg 97 is oriented horizontally, the forward surface of the lower leg 99 (and rear surface of the blade 3) lies along a plane which intersects the center of the journal 103. One of the journals 103 is rotatably mounted in a sleeve 105 (FIG. 9) attached to the interior surface of the associated main frame end wall 12. After the angular position of the angle member 96 has been set, the fasteners connecting the two journal halves are tightened to securely clamp the journal therebetween and prevent vibration of the knife bracket 95 The other journal 103 is mounted in a triangularly fashioned fastener arrangement, which as best illustrated in FIG. 9, includes three tabs 106 which project outwardly of the associated main frame end wall 12, having threaded apertures therethrough for receiving a fastener 107 therein. The tabs 106 are spaced apart a predetermined distance from the exterior surface of the journal 103 at 120 degree intervals, such that the position of the left hand journal is adjustable with respect to the right hand journal, so as to longitudinally align the knife blade bracket with the translation plane of the grinder abrasive element on beam 4. In this manner, should the knife edge 101 assume a non-parallel relationship with the plane of travel of the grinding wheel 26, the bolts 107 are adjusted to effect proper alignment. After the bracket 95 is set in the desired position, the fasteners 107 are tightened against the journal 103, thereby providing a zero tolerance fit which prevents vibration of the bracket with respect to the main frame 2**. The above described parallel adjustment is preferably only required at initial machine start up to eliminate manufacturing tolerances. However, the parallel adjustment can be made whenever it is required.

During the initial construction of the sharpener 1, the carriage frame 44 is mounted on the beam 4 and connected with the drive chain 77. The shaft 57 of each of the eccentric rollers 7 is then rotated, so as to diverge the free ends of the frame arms 46 and 47 and tense the same in a leaf spring fashion thereby applying resilient compressive forces between the rollers and the beam. It has been determined that a biasing force in the nature of six thousand pounds is sufficient to form a track in the way surface of the illustrated structure. One method for determining the compressive force applied between the beam 4 and the rollers 7 is to measure the resistance force which the carriage frame 44 displays toward longitudinal motion, such as by measuring the amperage (e.g. 15 amps) drawn by the drive motor 73. The carriage frame 44 and grinder 6 are then repeatedly translated along the beam from one extreme to the other, with the compressive force in the roller measured periodically and accordingly adjusted to insure that it remains at the desired level, and the carriage arms 46 and 47 remain tensed. The repeated translation under the resilient force applied to the rollers 7 causes the rollers to impress or roll a concave track 8 in each of the abutting way surfaces 5, wherein the roller is then retained and guided for accurate grinding of the knife blades. The rollers 7 are resiliently urged into the way surface 5 by the tensed carriage arms 46 and 47, and impress the track 8 to a self-seeking depth which provides sufficient surface area to nondeformably support each of the rollers thereon. After each of the tracks 8 has been so impressed, the apparatus is ready for sharpening the blades. The tension in the carriage arms 46 and 47 is maintained even after the tracks are formed, to insure accurate tracking of the rollers.

In use, each of the knife blades to be sharpened is inserted between the plate 99 and the lower leg 98 of the bracket member 95 in a side-by-side fashion as shown in FIG. 9. The fasteners 98*a* are then tightened to clampingly lock the knife blades 3 securely in place. By manipulation of the control wheel 29, the forward edge of abrasive grinding wheel 26 is translated adjacent to the cutting edge 101 of the blade. The bracket member 95 is then rotated in a manner so as to present the proper angle to the grinding surface. Because the blades are oriented substantially along a plane which intersects the axis of rotation of the bracket 95 (FIG. 10), the grinding angle may be varied considerably without requiring an inconvenient amount of adjustment in the location of the grinder. The grinder can then be translated from one end of the sharpener to the other to check the parallel relationship between the face of the grinder and the cutting edge of the blades. Since under normal circumstances, adjustment of the parallel relationship between the blades and grinder travel plane is not required, the above step can be deleted for expediency. However, if the relationship is checked, and adjustment is required, the bolts 107 are manipulated to position the bracket 95 and the blades 3 in a parallel relationship with the grinder. The grinder is then translated to one end of the sharpener, and the control wheel 27 is manipulated to position the grinding wheel inwardly at the desired surface depth, so as to grind the cutting edge of the blades as the same transverses thereby. The sharpener drive motor 73 is then energized, thereby translating the grinder carriage 44 back and forth along the beam, and sharpening each of the knife blades positioned in the sharpener. After each of the knife blades has been fully sharpened, the grinder is retracted to an extreme end of the beam, plate 99 is loosened, and each of the knife blades is withdrawn from the bracket 95.

In the foregoing description, it will be readily appreciated by those skilled in the art that various modifications may be made to the invention without departing from the spirit or scope of the invention as defined by the appended claims.

The embodiments of the invention in which an exclusive property or privilege is claimed are defined as follows:

1. A sharpener for industrial knife blades and the like, comprising:

a main frame having means for releasably retaining a knife blade in a fixed relationship therewith;

an elongate beam supported on said main frame; said beam having a substantially rectangular transverse cross-sectional shape that is generally uniform along the length of said beam, and defines first and second adjacent faces with a first corner edge therebetween, and third and fourth adjacent faces with a second corner edge therebetween;

grinding means for sharpening a cutting edge of the knife blade;

carriage means for movably mounting said grinding means on said beam for translation thereon along a plane disposed substantially parallel with the cutting edge of the knife blade; said carriage mounting means comprising:

a generally L-shaped support operably connected with said grinding means, and including first and second legs;

a first roller mounted on said first support leg, and oriented to ride on a first way surface on said first beam face adjacent to the first corner edge of said beam;

a second roller mounted on said first support leg, and oriented to ride on a second way surface on said second beam face adjacent to the first corner edge of said beam;

a third roller mounted on said second support leg, and oriented to ride on a third way surface on said third beam face adjacent to the second corner edge of said beam;

a fourth roller mounted on said second support leg, and oriented to ride on a fourth way surface on said fourth beam face adjacent to the second corner edge of said beam, whereby said rollers capture said carriage on said beam; and means for resiliently urging said rollers against the way surfaces on said beam for accurate grinding of the knife blade.

2. A sharpener as set forth in claim 1, wherein:

said support is semi-rigid and resilient in the plane of said support legs; and said first and fourth rollers are spaced apart in an unstressed support condition a distance that is slightly less than the distance between the first and fourth faces of said beam; and said second and third rollers are spaced apart in an unstressed support condition a distance that is slightly less than the distance between the second and third faces of said beam, whereby-when said carriage means is assembled onto said beam, said support functions as a leaf spring to resiliently urge said rollers against said beam faces and define at least a portion of said roller urging means.

3. A sharpener as set forth in claim 1, wherein said beam is a hollow member having a generally square cross-sectional shape.

4. A sharpener as set forth in claim 3, wherein:

said first and second beam corner edges lie in a plane oriented substantially horizontally.

5. A sharpener as set forth in claim 1, wherein:

said means for resiliently urging said rollers against the way surfaces on said beam comprises adjustable eccentric mounting shaft means for said rollers for varying the force between said rollers and the way surfaces of said beam.

6. A sharpener for industrial knife blades comprising:

a main frame including means for releasably retaining a knife blade in a fixed relationship therewith, and an elongate hollow beam having a rectangular cross section and having first and second way surfaces disposed on opposite faces of said beam, at least one of said way surfaces being positioned adjacent a corner of the beam;

grinding means for sharpening a cutting edge of the knife blade;

a carriage having means for movably mounting said grinding means on said beam for translation thereon along a plane disposed substantially parallel with the cutting edge of said knife blade; said carriage comprising at least one generally L-shaped support with opposite legs; said mounting means comprising first and second bearings mounted on the opposite legs of said support, and being positioned for abutting contact with said first and second way surfaces, respectively; and means for resiliently urging said first and second bearings against said first and second way surfaces to securely retain and guide said carriage on said beam for accurate grinding of the knife blade; said means including said bearings being mounted on eccentric shafts for varying the spring force between said bearings and said way surfaces.

7. A sharpener for industrial knife blades comprising:

a main frame including means for releasably retaining a knife blade in a fixed relationship therewith, and an elongate rectangular beam having first and second way surfaces disposed on mutually parallel faces on opposite sides of said beam, the way surfaces being positioned adjacent diametrically opposed corner edges of the beam;

grinding means for sharpening a cutting edge of the knife blade;

a carriage having means for movably mounting said grinding means on said beam for translation thereon along a plane disposed substantially parallel with the cutting edge of said knife blade; said carriage comprising at least one generally L-shaped support with opposite legs; said mounting means comprising first and second bearings mounted on the opposite legs of said support, and being positioned for abutting contact with said first and second way surfaces, respectively, thereby capturing said carriage on said beam; and means for resiliently urging said first and second bearings against said first and second way surfaces to securely retain and guide said carriage on said beam for accurate grinding of the knife blade.

8. A sharpener as set forth in claim 7 wherein the beam has third and fourth way surfaces on the other two faces of the beam and the carriage has third and fourth bearings mounted on the L-shaped support that ride on the third and fourth way surfaces.

9. A sharpener as set forth in claim 8 wherein the third and fourth way surfaces are positioned adjacent the same corner edges of the beam as the first and second way surfaces.

10. A sharpener as set forth in claims 7, 8 or 9 wherein the beam is a hollow member having a substantially square cross section.

* * * * *